United States Patent [19]

Finale

[11] 4,227,766

[45] Oct. 14, 1980

[54] SECURITY METHOD AND SYSTEM

[76] Inventor: Santiago I. Finale, 94 E. 18th St., Paterson, N.J. 07524

[21] Appl. No.: 7,754

[22] Filed: Jan. 30, 1979

[51] Int. Cl.[3] ..... G08B 13/08

[52] U.S. Cl. ..... 339/147 R; 339/176 M; 340/545; 340/550

[58] Field of Search ..... 340/545, 550; 339/176 R, 176 M, 147 R

[56] References Cited

U.S. PATENT DOCUMENTS

| | | | |
|---|---|---|---|
| 2,885,652 | 5/1959 | Rowe | 339/176 M |
| 3,911,414 | 10/1975 | Bowling | 340/550 |
| 3,924,256 | 12/1975 | Cohen | 340/545 |
| 4,097,109 | 6/1978 | Cross | 339/176 R |

FOREIGN PATENT DOCUMENTS

| | | | |
|---|---|---|---|
| 1190377 | 5/1970 | United Kingdom | 339/176 M |

*Primary Examiner*—John McQuade

*Attorney, Agent, or Firm*—Mel K. Silverman; Mahendra A. Gandhi

[57] ABSTRACT

The present invention discloses a method for interconnecting a plurality of security surfaces into a main alarm line. The method includes the steps of: placing a strip of electrically conductive foil about the periphery of each protected security surface; disposing a single-throw double-pole switch between adjacent, partially overlapping security surfaces which are movable with respect to each other; mutually connecting the peripherally disposed conductive strips of adjacent security surfaces so as to form a single circuit loop from the conductive strips placed about the periphery of adjacent security surfaces, the connection across adjacent surfaces occurring through the single-throw double-pole switch; and connecting the output of each of the single circuit loops formed through the use of the double-pole switch to the main alarm line. Further, the single-throw double-pole switch exhibits a novel structure which facilitates its usage in the present security method.

10 Claims, 9 Drawing Figures

FIG. 5
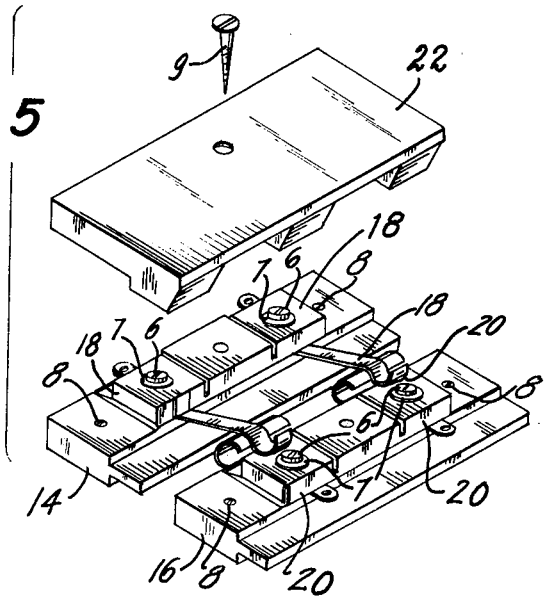
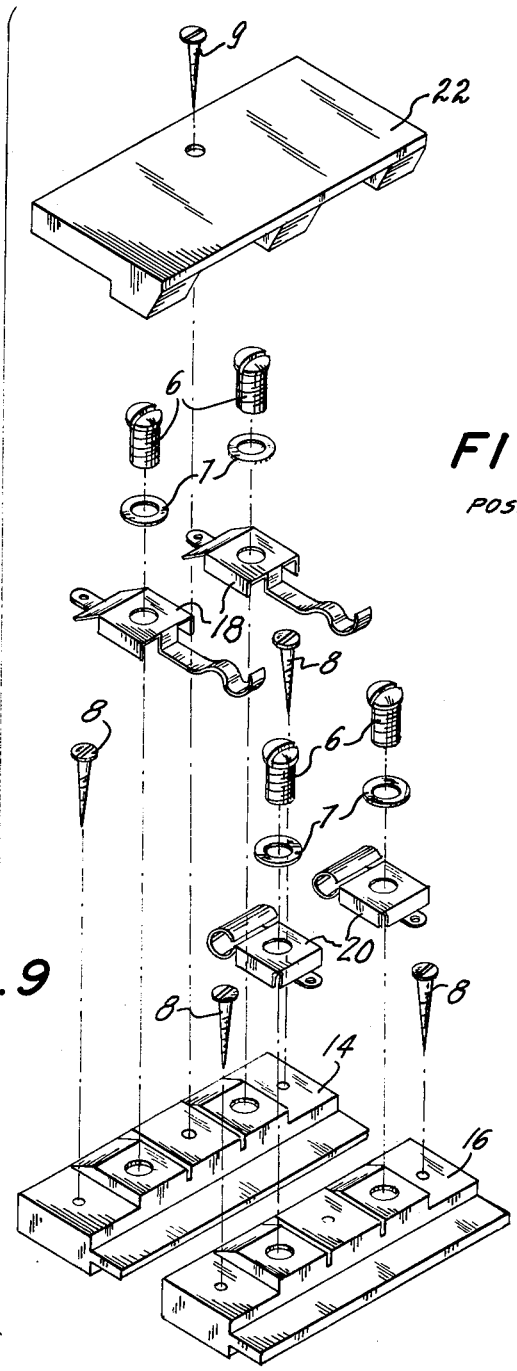
FIG. 9
FIG. 6
POSITION (A)
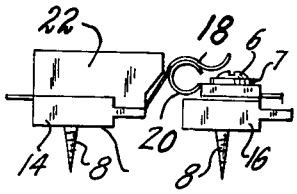
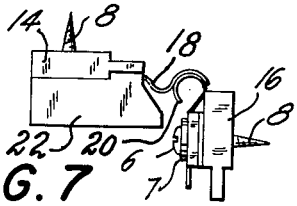
FIG. 7
POSITION (B)
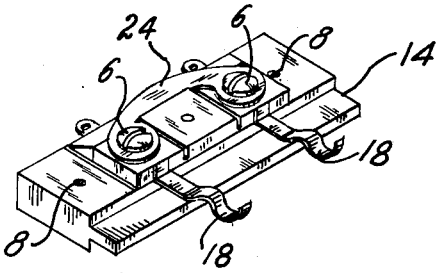
FIG. 8

SECURITY METHOD AND SYSTEM

BACKGROUND OF THE INVENTION

The present invention relates to a method, system, and device for facilitating the electrical connection of a plurality of security surfaces, for example, windows and doors, to a central alarm line, while minimizing the number of wires and connectors required in order to accomplish the same.

Prior systems have, heretofore, utilized an awkward and expensive wiring method in order to accomplish the comprehensive protection of the security surfaces common in residential and commercial buildings. Typically, electrically conductive tape has been placed about the periphery of each security surface, the protection of which is desired. Thereafter each of such surfaces, e.g., one pane of a double hung window, would require direct connection to the main or control alarm line. Resultingly, it was necessary to provide a separate connecting arrangement for each security surface for which protection was desired. In particular, see FIG. 1 which illustrates a typical prior art installation employing window foil tape and related sensors and wiring to the control alarm system.

The prior art is further represented by the following:

U.S. Pat. No. 1,003,234 (1911) to Cline, entitled Burglar Alarm.

U.S. Pat. No. 2,534,576 (1950) to Continenza, entitled Window Display Protector.

U.S. Pat. No. 3,087,145 (1963) to Fruh, entitled Burglar Alarm System and Switch Therefor.

U.S. Pat. No. 3,441,925 (1969) to White, entitled Window Apparatus Having Signal.

U.S. Pat. No. 3,623,061 (1971) to Mayhew, entitled Structure Security Alarm System.

U.S. Pat. No. 3,634,845 (1972) to Colman, entitled Window Security System.

U.S. Pat. No. 3,696,373 (1972) to Dunn, entitled Electric Alarm Screen.

U.S. Pat. No. 3,863,242 (1975) to Minton, entitled Electric Screen Protection.

U.S. Pat. No. 3,993,988 (1976) to Walter, entitled Intrusion Detection Apparatus to Signal Movement of a Partition.

The prior art is also represented by such publications as:

*Build Your Own Home and Car Security,* Motorola Publications, Pages 14 through 16.

*Security and You,* Hydrometals Inc., Rockford, Ill., Page 105.

*Home Security Handbook,* Eico Electronic Instrument Company, Pages 22 to 27.

*Security for your Home,* by Radio Shack.

*Electronic Intrusion Alarms,* The Bobbs-Merill Company, Howard W. Sams.

"*Protective Alarm Devices*", Easi-Bild by Donald R. Brann, Page 85.

The present invention constitutes a response to the needs of the prior art as exemplified in the above.

SUMMARY OF THE INVENTION

The instant invention provides a window foil bridge for connecting loops of conductive strips of foil disposed peripherally about respective security surfaces. The window foil bridge permits the uninterrupted flow of current between two movable security surfaces, so long as the disposition between the respective surfaces is not substantially changed as, for example, by the opening of the upper or lower half of a double hung window. Accordingly, the prime function of the foil bridge is to maintain a current flow between adjacent foil current loops without inhibiting normal movement or usage of the security surfaces during periods of the day when it is not necessary to employ the security function of the foil strips.

The present system also provides for interconnection of a plurality of security surfaces into a main line, said system comprising: (a) a strip of conductive foil placed about the periphery of each of a plurality of security surfaces; (b) a single-throw double-pole switch, alternately termed a window foil bridge, disposed in one or more of a variety of angulations between adjacent partially overlapping security surfaces, said security surfaces being movable with respect to each other; (c) a plurality of single circuit loops, each of said loops themselves comprising a combination of mutually connected conductive strips disposed about individual security surfaces, said connection of adjacent surfaces occurring through said foil bridge switch; and (d) a main alarm line having as the input thereto each of the outputs of said single circuit foil loops whereby, through such system, the need for individual and direct connections of each of the security surfaces to the main alarm line is thereby eliminated. Further, free usage of the security surfaces in their natural function, for example, opening of a window or door, is permitted during periods when it is not necessary to activate the security system.

In view of the above, it is an object of the present invention to provide a method for connecting security surfaces to a main alarm line which will not inhibit the normal utilitarian function of such surfaces during periods when it is not necessary to actuate the security system, for example, during the day.

It is a further object to provide a security method which will simplify the process of connecting a plurality of security surfaces to a main alarm line.

It is a still further object to provide a security method which will be less costly than prior art methods.

Yet further objects of the present invention will become apparent from the hereinafter set forth detailed description of the invention in combination with the drawings.

BRIEF DESCRIPTION OF THE DRAWINGS

FIG. 5 is a perspective view of a window foil bridge showing the two elements thereof in a first position, and further showing the protective cover for one of the two elements of said bridge in a detached position thereabove.

FIG. 6 is a cross-sectional schematic view of the window foil bridge of FIG. 5.

FIG. 7 is a schematic cross-sectional view of the window foil bridge of FIG. 5, however, showing the respective connector elements thereof disposed at a ninety degree angle to each other.

FIG. 8 is a perspective view of one element of the double-throw switch provided with a supplemental bridge, thereby permitting such element to be used as a circuit interrupter for such security surfaces as a hanging door or other such solid surface not having therein a breakable element such as a window.

FIG. 9 is an exploded view of the window foil bridge elements as indicated in FIG. 5.

DETAILED DESCRIPTION OF THE INVENTION

Figure 1:
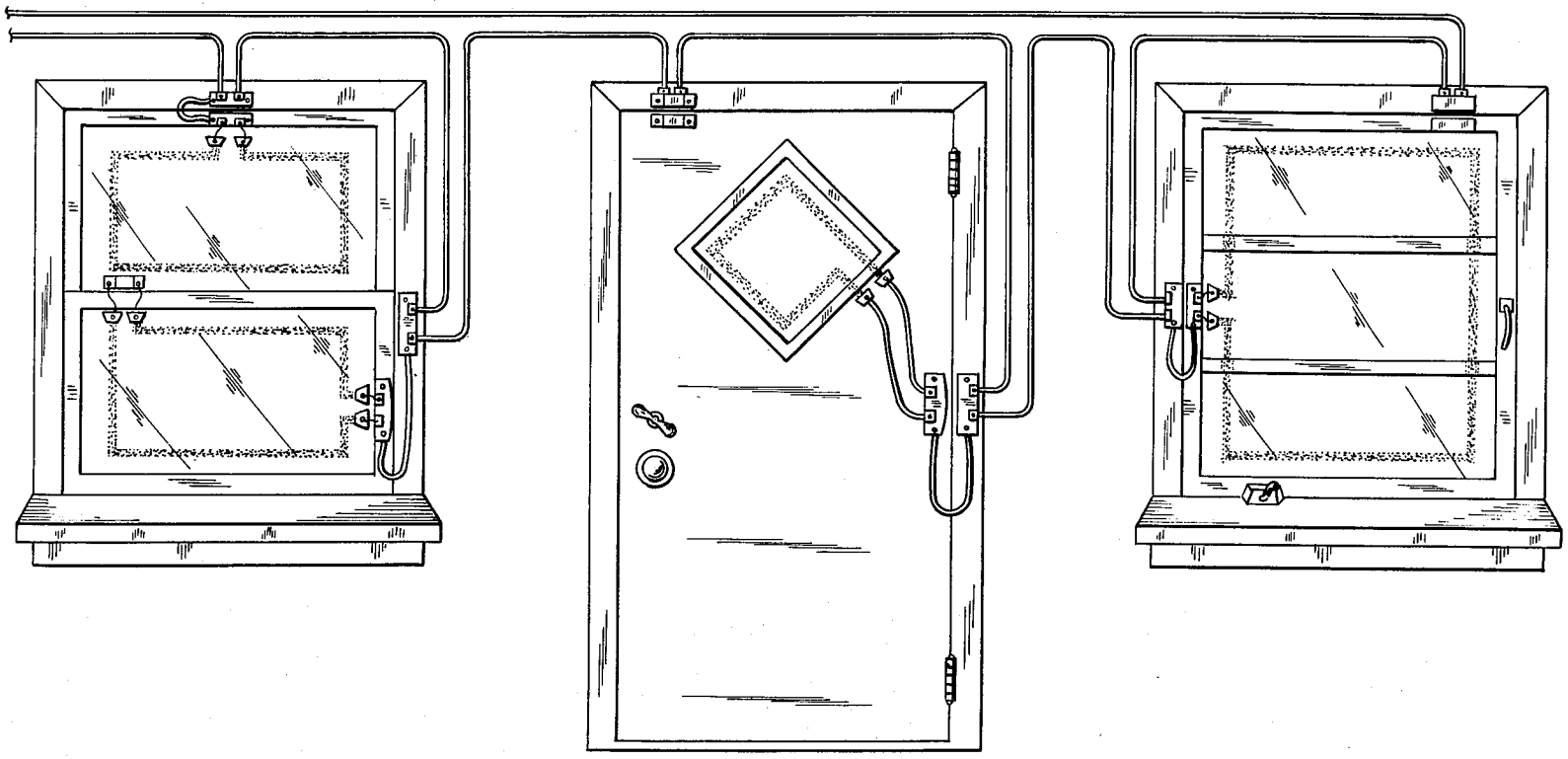
FIG. 1 PRIOR ART
FIG. 1 comprises a representation of the wiring installation pattern as employed in the prior art.

There is shown in FIG. 1 a typical prior art connection of a plurality of security surfaces to a principal control alarm system. As may be noted, it was necessary for each security surface to constitute a separate circuit loop and for such circuit loop to be directly connected to the main line for the control alarm system. Such connection requirements created a situation in which the security surfaces to be protected could not be utilized in their normal utilitarian fashion even during such periods, for example, during the day, when activation of the security system was not necessary. For example, the double hung windows could not be readily opened and closed in the prior art method. Also, the considerable cost and inconvenience associated with the numerous connections required in the prior art are apparent upon a viewing of FIG. 1.

Figure 2:
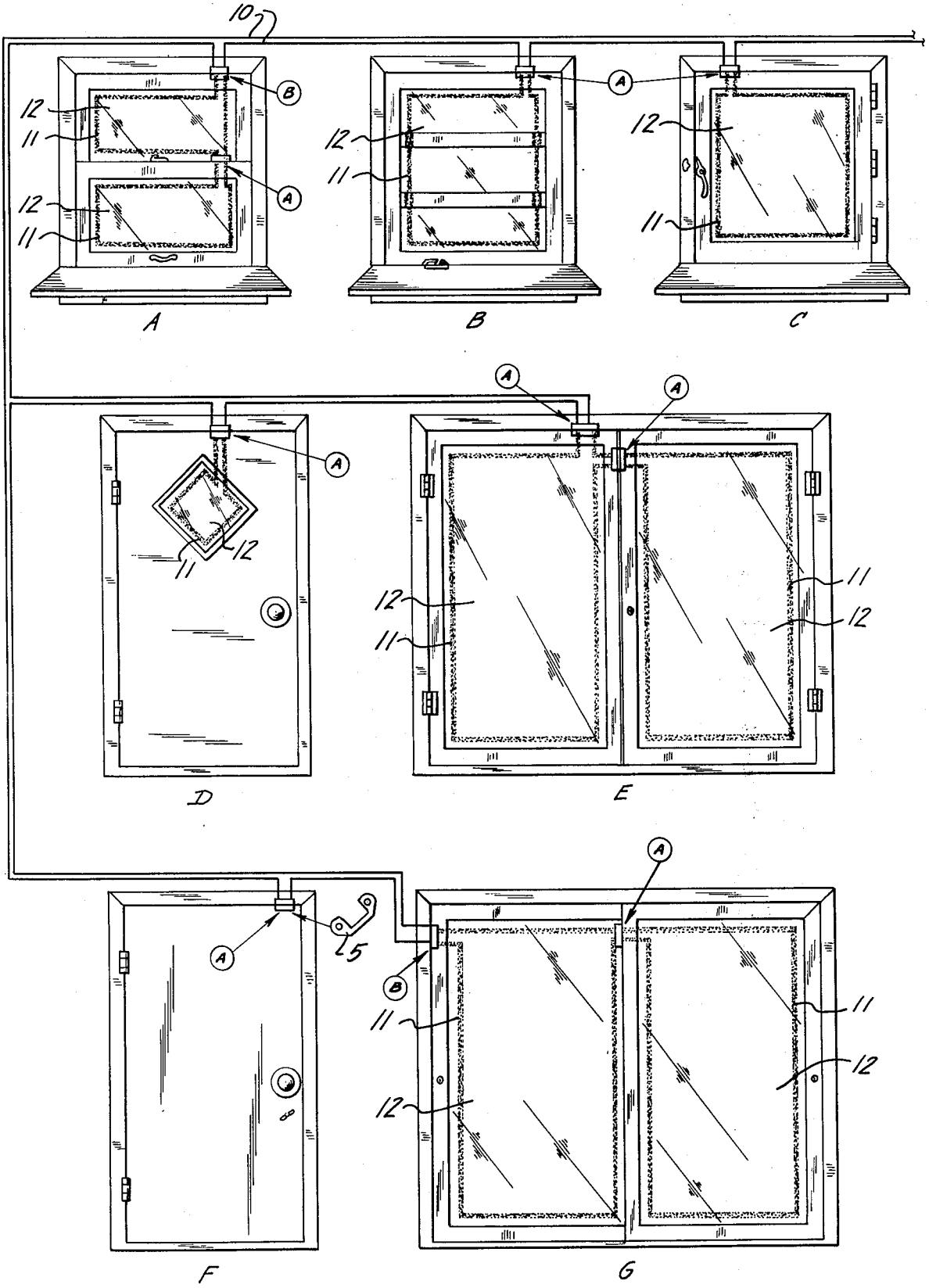
FIG. 2 is a systems illustration of the present method of wiring installation as applied to double hung, casement, and hanging windows, as well as hanging, double hung, and sliding doors.

With reference to FIG. 2, there is illustrated seven examples of suitable applications for the present invention. In FIG. 2A a strip of electrically conductive foil 11 is disposed about the periphery of each security surface 12. As may be noted from an examination of each of the figures which comprise FIG. 2, the conductive foil is disposed about the periphery of the particular conductive surface, whether that surface comprises a portion of a double hung window (A), a casement window (B), a hanging window (C), the window of a hanging door (D), a portion of a double hanging door (E), a hanging door (F), or a portion of a sliding door (G).

Employed in association with the electrically conductive foil is a window foil bridge, hereinafter described in further detail, said window foil bridge consisting of a first base and a second base, said first and second bases typically being disposed in either one or two positions. The first mode of mutual disposition between the respective base elements of the window foil bridge is denominated as position A (see FIG. 2A), while the second mode of mutual disposition of the base elements is denominated as position B (also see FIG. 2A). In position A (more particularly further shown in FIG. 6) the first and second base elements 14 and 16 respectively are disposed within the same lateral plane as each other. Position A is most commonly used in order to accomplish window foil connections between security surfaces which are mutually movable with respect to each other as, typically, appear at the horizontal center plane of a double hung window and sliding door.

Position B, shown in further detail in FIG. 7, is typically employed where one security surface is movable with respect to a fixed perimeter or jamb of, for example, the top of a double-hung window. In Position B, the respective base elements of the window foil bridge are disposed at a 90 degree angle with respect to each other, with the horizontally disposed element 14 affixed to the non-movable surface, while the vertical element 16 is affixed to the movable security surface.

With reference to the detailed structure of a typical window foil bridge, it may, by reference to FIGS. 5, 6 and 7, be noted that the first base element 14 of the window foil bridge includes a means for attachment to the security surface 12, which means, typically, comprises a hole and screw combination. As shown in FIGS. 5 and 9, screws 6, 8, and 9, and washer 7 are used for securing the base elements and a protective cover 22. Further, the first element is provided with a pair of contact arms 18 which are adapted for engagement with a corresponding pair of receptor arms 20 which are affixed to the second base element 16 of the window foil bridge. It is further noted that the contact and receptor arms are formed of suitable conductive materials such as brass or copper, while the support elements for the window foil bridge are formed of a moldable insulating material such as plastic or mica.

Also provided is a protector cover 22 which is employed in order to reduce the probability of damage occurring to the structure of the window foil bridge.

There is, as a further embodiment, provided a supplementary bridge 24 (see FIG. 8) which is applicable in those situations in which it is necessary to employ the first base element 14 as a simple circuit breaker or interrupter as, for example, in the case of a hanging door. In this regard see FIG. 2F. One or both of the contact receptors 20, and one or both of the contact arms 18 are provided with the supplementary bridge 24, as required. The pair of contact arms 18 as shown in FIGS. 5 and 8, includes a leaf spring shaped element at one end and flat shaped at the other end.

The window foil bridge is further shown in the exploded view of FIG. 9. In this view the various contact arms and receptors are illustrated as are the molded base elements 14 and 16. Also, representative holes and screws are indicated for purposes of securement of both the contact elements to the base elements and the base elements to the desired security surface.

Figure 3:
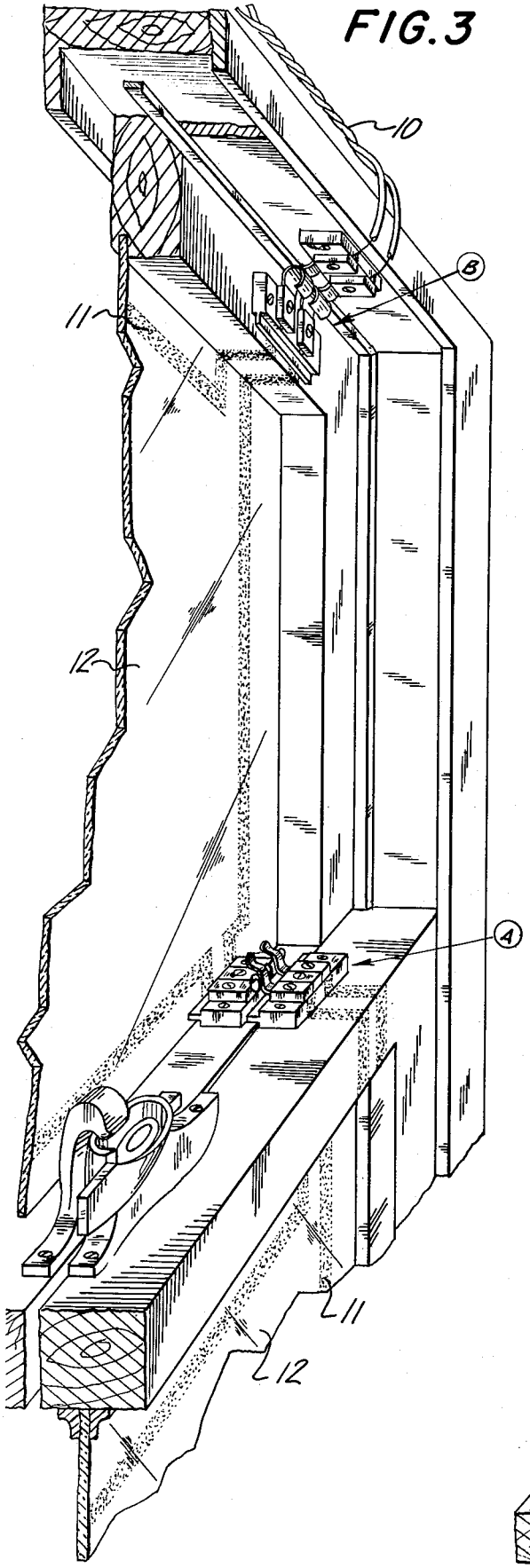
FIG. 3 is a perspective view of the present novel single-throw double-pole switch, alternatively termed a window foil bridge, as disposed in two representative locations within the present security system, the first location being a point of electrical connection between two respectively movable security surfaces, and the second location being the point of electrical connection between the security surfaces and the main alarm line.
Figure 4:
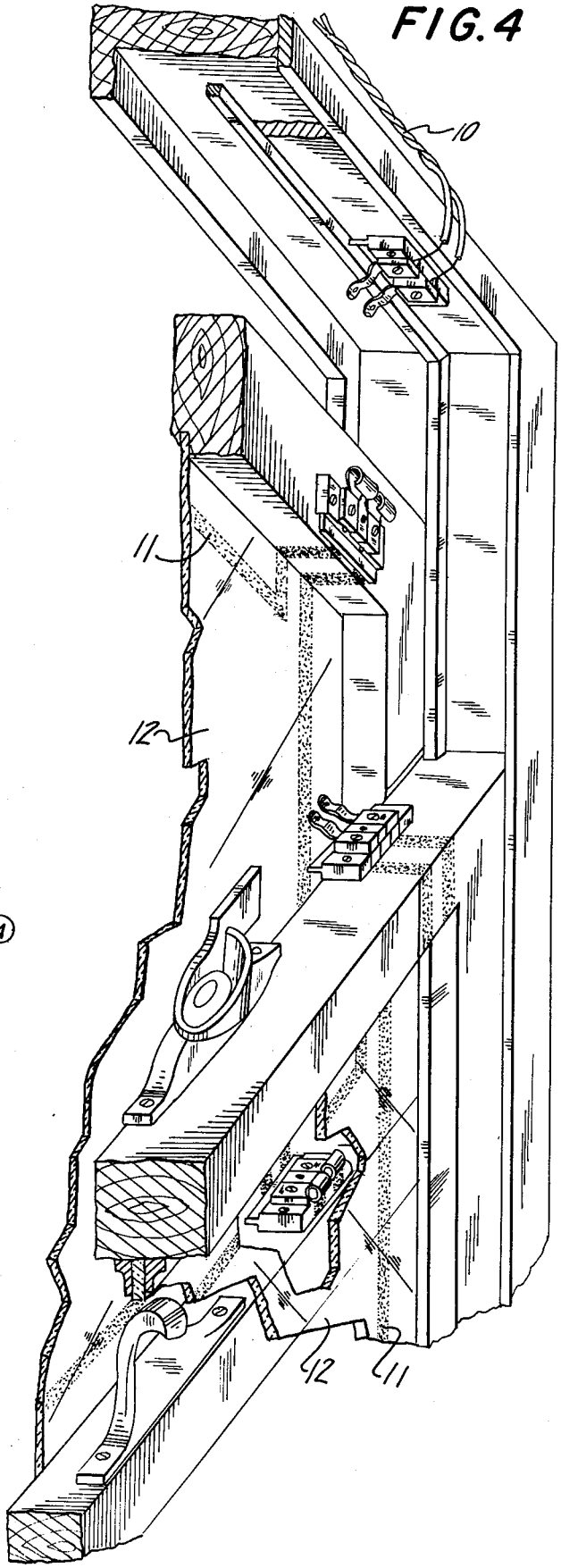
FIG. 4 is a perspective view similar to that of FIG. 3, however, showing the relative disposition of the two elements of the window foil bridge upon the occurrence of movement of one of the security surfaces as to thereby cause an electrical discontinuity between the respective elements of the window foil bridge.

In FIGS. 3 and 4 there is, in perspective view, illustrated both Position A and Position B attachments of the window foil bridge with reference to the double hung window appearing schematically in FIG. 2A. As may be appreciated by comparison of FIG. 4 to FIG. 3, upon movement of the upper security surface with reference to the lower security surface, the connection between the contacter and receptor arms of the window foil bridge is opened, thereby creating an open circuit to the main alarm line 10. Inasmuch as the alarm is connected so as to function in a normally closed condition, the opening of the circuit will actuate the main alarm and its associated connection to a security control center, e.g., a local police headquarters.

Accordingly, it may be appreciated that the objects set forth in the Summary of the Invention have been effectively obtained by the Detailed Description of the Invention as set forth above. Further, while there have been shown and described the preferred embodiments of the present invention, it will be understood the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention, what I claim as new, useful and non-obvious, and accordingly secure by Letters Patent of the United States is:

1. A system for interconnecting a plurality of security surfaces into a main alarm line, comprising:

(a) a strip of electrically conductive foil placed about the periphery of each of a plurality of security surfaces;

(b) a plurality of foil bridges, each of said bridges installed between adjacent, partially overlapping security surfaces, among said plurality of security surfaces, said overlapping security surfaces being movable with respect to each other;

(c) a plurality of single circuit loops, each of said loops themselves comprising a combination of mutually connected conductives strips of individual security surfaces, a connection of these security surfaces occurring through said foil bridges; and (d) a main alarm line having as an input thereto each of an output of said single circuit loops.

2. The system as recited in claim 1 in which each of said plurality of foil bridges comprises:

a first base including a means for attachment to a first security surface;

a second base including means for attachment to a second security surface, said second surface being mutually movable with respect to said first surface;

a pair of contact arms mounted on the first base; and a pair of contact receptors mounted on the second base.

3. The system as recited in claim 2 in which both of said contact receptors is further provided with a supplementary bridge mounted in electrical connection therebetween.

4. The system as recited in claim 2 in which both of said contact arms is further provided with a supplementary bridge mounted in electrical connection therebetween.

5. The system as recited in claim 2 in which said system further comprises a protector cover adapted to fit upon the first base in order to protect the contact arms thereof.

6. The system as recited in claim 3 in which said pair of contact arms, the pair of receptors and the supplementary bridge comprise conducting material.

7. The system as recited in claim 5 in which said first base, the second base, and the protector cover are made of moldable insulating material.

8. The system as recited in claim 2 in which said pair of contact arms further comprises a leaf spring shaped element at one end and flat at the other end of each contact arm.

9. The system as recited in claim 8 in which said pair of contact receptors further exhibits a circular shape, the same being capable of electrical connection by suitably overlapping with the opposite end of said leaf spring shaped contact arm.

10. A method for interconnecting a plurality of security surfaces into a main alarm line, comprising the steps of:

(a) Placing a strip of electrically conductive foil about the periphery of each security surface;

(b) installing a foil bridge between adjacent, partially overlapping security surfaces which are movable with respect to each other;

(c) mutually connecting said peripherally disposed conductive strips of adjacent security surfaces so as to form a single circuit loop from the conductive strips of said adjacent security surfaces, said connection of adjacent surfaces occurring through said foil bridges; and (d) connecting the output of each of said single circuit loops to the main alarm line.

* * * * *